United States Patent [19]

Frederiksen

[11] Patent Number: 4,934,116

[45] Date of Patent: Jun. 19, 1990

[54] FLOOR COVERING OF ELECTRICALLY CONDUCTING TYPE

[76] Inventor: Ole Frederiksen, Ved Gadekäret 6, DK-8520 Lystrup, Denmark

[21] Appl. No.: 246,300

[22] PCT Filed: Jan. 12, 1988

[86] PCT No.: PCT/DK88/00004

§ 371 Date: Sep. 12, 1988

§ 102(e) Date: Sep. 12, 1988

[87] PCT Pub. No.: WO88/05105

PCT Pub. Date: Jul. 14, 1988

[30] Foreign Application Priority Data

Jan. 12, 1987 [DK] Denmark ..... 0118/87

[51] Int. Cl.[5] ..... E04H 14/00

[52] U.S. Cl. ..... 52/173 R; 52/385

[58] Field of Search ..... 52/173, 126.6, 588, 52/386, 387, 389

[56] References Cited

U.S. PATENT DOCUMENTS

| | | | |
|---|---|---|---|
| 3,962,504 | 6/1976 | Sherwin | 52/173 R |
| 4,453,365 | 6/1984 | Gladden | 52/716 |
| 4,546,024 | 10/1985 | Brown | 52/385 X |
| 4,745,715 | 5/1988 | Hardwicke et al. | 52/126.6 |
| 4,790,110 | 12/1988 | Bard | 52/173 R |

*Primary Examiner*—David A. Scherbel
*Assistant Examiner*—Creighton Smith
*Attorney, Agent, or Firm*—Antonelli, Terry, Stout & Kraus

[57] ABSTRACT

Modular tiles, integrated with a flooring of a conducting type, are manufactured of electrically conducting plastic, whereby a grounding ability is achieved without sacrificing any advantage of the modular tiles. The conducting modular tiles may be laid in selected places in an assembled flooring and can be shifted to other places in dependence upon specific requirements. The individual conducting tiles may be connected to a grounding wire laid out beneath the tiles such that none of the flooring will be far from a direct ground connection.

11 Claims, 2 Drawing Sheets

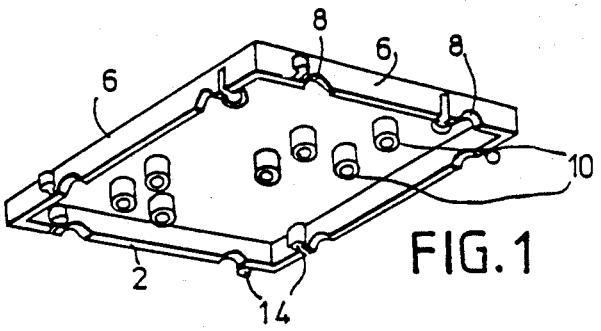
FIG. 1
FIG. 2
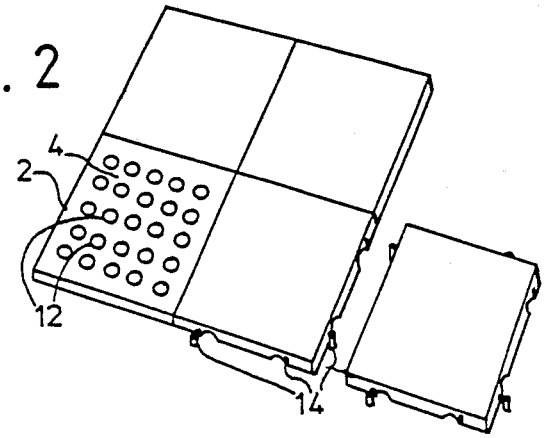
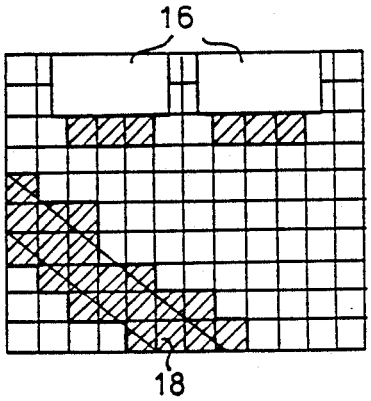
FIG. 3
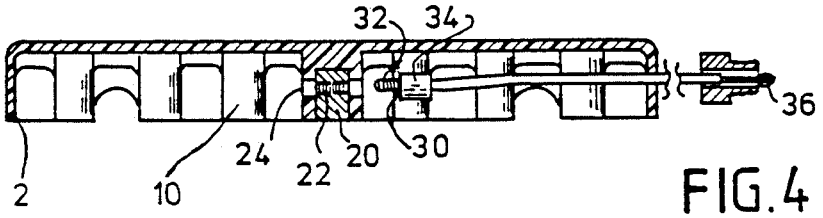
FIG. 4

FLOOR COVERING OF ELECTRICALLY CONDUCTING TYPE

BACKGROUND OF THE INVENTION

The present invention relates to a floor covering of electric conducting type for use in premises where it is desired to avoid static electricity by grounding. Such coverings have been developed in several types, e.g. so-called carbon mats, but a common feature for all coverings is that focus is on the grounding ability to such an extent that other qualities in a floor covering have not been particularly considered. It is presumed that the crucial point is the grounding ability in such a special floor covering as the appearance of major static charges, let alone even very small sparks, can have dire consequences and it is considered of secondary importance whether the floor covering is reasonably appropriate in all other respects, e.g. with regard to walking and standing comfort, cleanability, wear resistance etc., even to a certain degree price.

The present invention breaks with this concept and its purpose is to provide a floor covering which, while fully allowing for grounding ability, at the same time widely provides for all other requirements for floor covering in working premises.

The invention is based on the recognition that exceedingly appropriate floor coverings have already been developed which, true enough, have not been provided with grounding qualities, but which may be easily modified to also show this capacity without such modification in any way harming the other good qualities as adapted to the purpose.

Reference is here made to floor coverings of plastic tiles of the type having principal dimensions of the magnitude 25×25×2 cm and being designed with an unbroken or perforated top plate which is supported at a number of integral rib or stud parts protruding downwards therefrom, with the rib or stud parts being mutually spaced and supporting the top plate on an underlying firm floor surface. Additionally the tiles are designed so that they can be laid closely against one another in a mutually interlocking fashion. It has been ascertained that floor coverings of this type have a multitude of advantages for a variety of reasons, regarding as well usability as maintenance and mounting. By the invention it is recognized that none of these good qualities will be sacrificed by the simple measure of manufacturing the tiles of a plastic material of the special kind having good electrical grounding abilities. Contradictory to the above view it could be said that such an intended ideal floor covering so far has been developed without consideration for the special quality that for certain uses it is desirable that the covering is electrically groundable.

It is not immediately particularly conspicuous that a covering built of relatively small, die-cast tile members can qualify as a groundable flooring, which in principle ought to be spread over a large area, but it is realized by the invention that often only relatively restricted areas having grounding qualitites are required, e.g. at permanent seats or standing room at existing worktables, and even though the tile elements in an electrically conducting version will be more expensive to produce than corresponding non-conducting elements, the corresponding increase in cost can, however, be limited to the partial areas concerned, while the flooring as a whole can appear in a uniform way. Especially as die-cast, comparatively small covering elements are used, the employment of the more expensive, electrically conducting elements can easily be limited to precisely the actual walking or standing areas.

In the light of this the covering according to the invention is characteristic in that it includes modular elements of intercoupled plastic tiles of the type being designed with an optionally perforated resilient stepping plate which at its bottom side has a number of mutually separated downward projecting supports and along the edges is provided with coupling means enabling the tile to be interlocked with an adjacent tile, with the entire floor covering is divided into two or more partial areas, that is one or more relevant subareas with tiles having electrical conducting ability and one or more subareas with tiles having no such ability.

The type of tile elements considered here has the advantage that the resulting flooring can be adapted extensively to various or changed positions of machinery beds and other primary limitations to the floor space in that the tile elements conveniently can be taken up and relaid anywhere, as they are stabilized only by their interlocking with other corresponding tile elements. Correspondingly any subarea consisting of conducting tiles may be established anywhere.

As another major advantage the tile elements of the considered type are "foot kind" in the sense that their top plates are resiliently flexible in the areas between the bracing supports, whereby a quite substantial therapeutical effect on the user's feet is achieved. This major advantage can be fully maintained by the invention because the effect in question is not much influenced by the material being of electrically conducting or non-conducting plastic.

The plastic tiles have the further advantage that they are easily cleaned, and this advantage is not jeopardized by using plastic of the electrically conductive type in the manufacture. The covering can simply appear exactly as before.

For the intended effect it obviously does not suffice that the tile elements themselves be electrically conductive, as they should also be effectively grounded. When placed on a support floor which in itself has a sufficient grounding ability, the grounding can be effected immediately through the tiles where the relevant current path down through the support parts will be comparatively short, i.e. the tiles may or must have only a low conductivity, whereby they can be correspondingly inexpensive. No improvement of the grounding will be obtained through the use of the tiles, but it is achieved that the walking or standing persons get a considerably improved floor surface to walk or stand on, that is the same improved floor surface which is also found at the less critical grounding subareas where it is advantageous and acceptable to place the less expensive, non-conductive tiles.

When building up the flooring on a non-ground floor the problem is entirely different, as a grounding with comparatively long current paths in the horizontal direction to a suitable ground connection is required. Underneath the tiles a grounded metal foil can be placed, but this solution is none too attractive. As the tile elements are joined by special interlocking means they could also hereby be electrically interconnected, but it is considered dubious to rely on the necessary perfect contact always being established hereby. Admittedly the engagement parts could be optimized from an electrical contact point of view, but the fact remains that for an efficient grounding from a single point of a large floor area an almost metallic conductivity in the material would be required, and it is a fact that the plastic material for the actual purpose is substantially more expensive, the higher the conductivity is to be.

According to the invention the low-cost of the material as well as a high grounding safety of even a large floor space are considered by producing as a standard the individual tile elements with an embedded, central contact member which at the laying of the tile is suited to be directly wire connected with the contact members of the other elements, whereby it suffices to ground the net of highly conducting wire connections in question at a single spot or at several places where large areas are concerned. Hereby, irrespective of the area of the floor space, the individual tile elements only have to be made in such a way that with a required efficiency they can conduct electricity away from their own small area, even limited to the area parts between the edge and the center of the element, which in practice means a maximum distance of some 20–30 cm. Normally, this will be possible by means of an only moderately conducting plastic material, i.e. a reasonably inexpensive material.

When using the wire connections mentioned, it is pertinent to lay out wires on the rigid floor space underneath the tile elements which, however, can be done without any special problems provided some lower recesses are provided in the edge ribs supporting the elements at the floor. It should be mentioned that the known tile elements are already provided with such recesses, as they are already prepared for use on floor spaces where either laid out wires occur, e.g. exhibition stand floors, or where water should be able to be drained off.

It should be noted that the plastics in question must necessarily be produced by die-casting from a basic material which in itself is pronouncedly electrically insulating, i.e. a conducting material must be incorporated which can create the required moderate conducting ability. In practice a conducting fibre material ought to be used, preferably carbon fibres, and practice has shown that when die-casting such a composite material, it is rather dubious whether the resulting tile will attain the required conducting ability in the horizontal and/or vertical direction between different surface parts thereof, because the fibres do not necessarily remain in a homogeneous admixture within the material by the injection thereof into the compact mould. Therefore it has been found necessary to subject every single tile member produced to a control measuring of the conductivity in the horizontal and vertical direction, respectively, and it has been found hereby that a considerable percentage of rejects may occur, which of course will contribute to the conducting tiles generally being appreciably more expensive than the pure plastic tiles.

BRIEF DESCRIPTION OF THE DRAWINGS

The invention is explained in more detail below with reference to examples illustrated in the drawing, wherein FIG. 1 is a perspective view of a floor covering tile seen from below;

FIG. 2 is a top view of a group of assembled tiles;

FIG. 3 is a plan view of a floor covering performed with both earthed and non-earthed covering tiles;

FIG. 4 is a lateral sectional view of a tile with associated electrical connection means;

DETAILED DESCRIPTION

Figure 5:
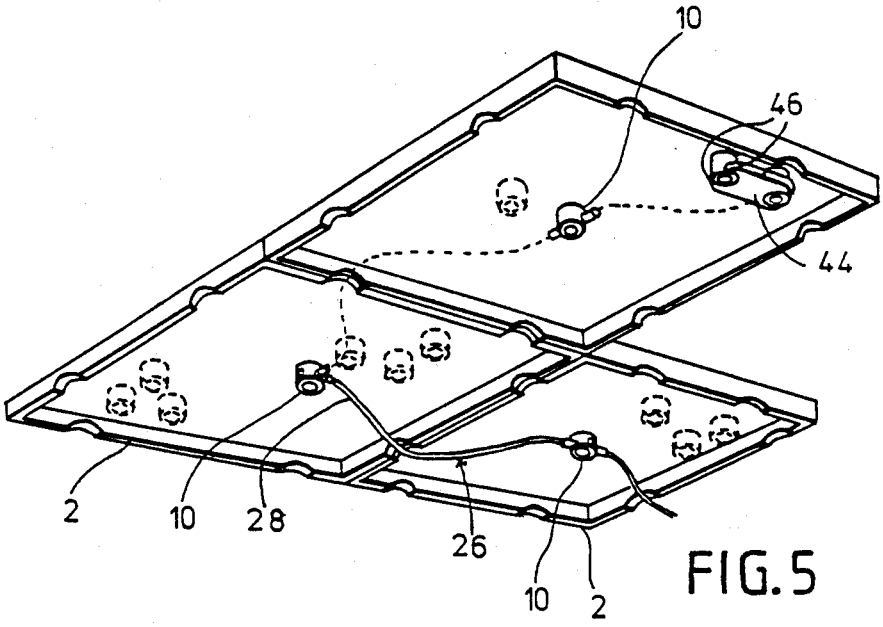
FIG. 5 is a corresponding perspective view of a number of tiles seen from below.

The tile elements 2 shown in FIGS. 1 and 2 are of a known design and will be described only briefly. They are die-cast in a semi-soft plastic material and have a top plate part 4 and along the circumference thereof a downwardly protruding edge wall 6, in the free lower edge of which recesses 8 are formed. At its lower side the top plate 4 is provided with a number of downwards protruding support studs 10 in a regular pattern, with these studs 10 preferably having a cylindrical form that is open at the lower side. The top plate part 4 can be unbroken or be designed with large or small holes 12 in the areas between the support studs 10. The edge walls 6 are integrally shaped with locking members 14, by which the tile elements 2 can be joined to form a large coherent flooring.

By the invention these tile elements are modified by being manufactured of an electrically conducting plastic or rather by manufacturing uniform tiles in a non-conducting as well as in a more expensive conducting plastic such that in a given flooring conducting tiles can be incorporated everywhere this may be desired.

FIG. 3 shows an example where a floor area has a covering of tiles 2, of which those marked in shading are of the conducting type, these being placed solely in places where an electrostatic grounding is imperative, thus in the example shown at the working positions opposite a couple of assembly desks 16 as well as along a diagonal walking area 18. For such an oblique path tiles of identical appearance as the surrounding tiles can appropriately be used, while for marking of more regular areas such as straight paths and working positions tiles of a different appearance can be used.

If the conducting tiles shall merely be grounded to a grounded underlying floor space per se it suffices, as already mentioned, that the individual tiles in the area concerned are suitably conductive between their upper and lower sides while when laying the tiles on a non-grounded floor space it should be ensured that the tiles 2 are in mutual conducting connection and that they are all efficiently connected to a grounding wire. By the invention it is preferred that all individual tiles are in direct contact with the grounding wire as the individual tiles will then only require a comparatively small conductivity in the horizontal direction.

FIGS. 4 and 5 show that one of the cylinder studs 10, i.e. a stud in or near the center of the tile 2, is provided with a brass block 20 pressed up from below, which is provided with four horizontal radial bores 22, which between their inner ends leave a central core part of the block, and the cylinder stud 10 concerned is provided with side holes 24 exactly opposite the respective four orifices of these bores. A set of connecting wire elements 26 belongs to the tiles, with the wire elements 26 each including a wire part 28 which is slightly longer than the center distance between two adjoining tiles and at both ends is provided with a coupling 30 consisting of a brass bushing with a protruding thread part 32 and a handle part 34. On the corresponding end of the wire 28 a terminal member 36 is wedged or soldered which by the threading of the coupling 30 into a radial bore 22 is brought to press against the bottom of the bore, i.e.

against the said central core part of the block 20, whereby a safe electrical contact between the wire 28 and the block 20 is achieved. A wire element 26 can thus be used for mutual electrical connection of two adjoining tiles, and, as the block 20 has four thread holes 24, each tile can thus be connected with up to four adjoining tiles.

At its cylindrical outer side, the block 20 is provided with axially extending projections, which can press or carve themselves slightly into the inner wall of the cylinder stud 10 and thereby act not only as an extra hold on the inserted block, but also to provide extra electrical contact, that is, by cutting the adjoining conductive fibres, preferably carbon fibres that are incorporated in the plastic material.

Figure 6:
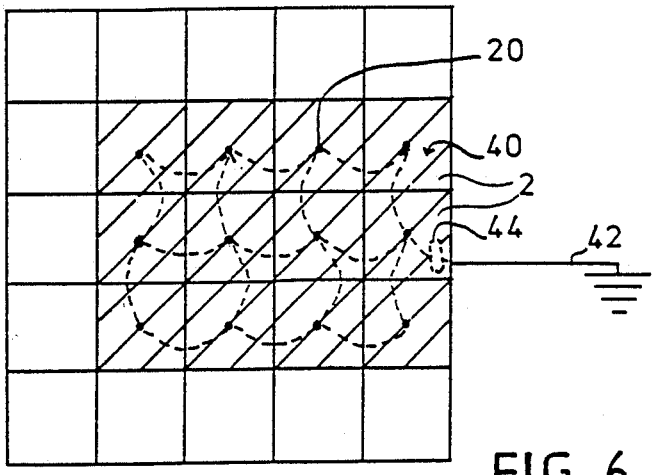
FIG. 6 is a plan view illustrating the electrical connection between several tiles in a flooring area of earthed tiles.

FIG. 6 shows a section of a floor covering which is placed on a non-grounded underfloor and comprising a shaded area generally designated by the reference numeral 40 with grounded tiles 2, partly surrounded by and coherent with corresponding plastic tiles of non-conductive type. The center 20 of the grounded tiles are mutually connected by the wire elements 26, and as shown, the preferred rule is to direct wire connect any or all adjoining tiles irrespective of extra connections occurring hereby which can seem superfluous. The reason for this rule is that the floor covering can be laid and assembled by non-professionals whereby a certain risk occurs that some of the electrical connections are not established quite to perfection, and it is consequently to be expected that a sufficiently safe connection will be achieved when a plurality of connections to the individual tiles is established.

The tiles 2 shown in the area 40 are connected to a ground wire 42. This connection is established through a resistance unit 44 ensuring a suitably high grounding resistance, e.g. of the magnitude 1M Ohm in order that grounding of static electricity is ensured when a person is standing in the area 40, but without the person being susceptible to immediate grounding which can cause sparks or shocks if live wire parts are touched.

As indicated in FIG. 6 and shown in more detail in FIG. 5 the grounding resistance can be placed in a special resistance block 44 which is provided with engagement parts 46 for clamped fixture to two adjoining stud parts 10 of a tile 2. This resistance block 44, which contains the resistance block 44, can at one of its sides be shaped with a threaded bore accommodating a standard coupling 30, whereas, at its opposite side it has a differently shaped connection terminal, e.g. a thread hole of a larger diameter for connecting the grounding wire 42.

It will be appreciated that the invention is not limited to the method of connecting the tiles and the connection wires described in detail as these connections obviously can be established in a multitude of different ways. The crucial point is that in the entire floor covering distinction is made between the groupings of joined and in principle identical, grounded and non-earthed tile elements, respectively, whereby a high quality grounded flooring can be substantially reduced in price by establisheing grounded areas solely where really needed, while the entire flooring is of a kind that is especially easy on the feet and legs when walking and standing and having the possibility of easy shifting of partial areas of the covering with regard to the grounded and non-grounded areas in mutually mechanical, releasable engagement.

It should be noted that an especially appropriate embodiment of the connectable tile elements is defined in the Danish patent application No. 4592/84 corresponding to U.S. Pat. No. 4,807,412.

I claim:

1. A floor covering of an electrically conducting type for use in premises where static electricity is to be avoided, the floor covering comprising modular elements of joined plastic tiles having a plurality of mutually spaced downwardly protruding support parts along a lower edge thereof and coupling means along edges thereof for enabling the tile to be coupled with an adjoining tile, wherein the entire floor covering is divided into at least two subareas with at least one of the subareas including electrically conductive tiles and at least one of the subareas including non-conductive tiles.

2. A floor covering according to claim 1, wherein the tiles in the at least two subareas are of substantially identical shape.

3. A floor covering according to claim 1, wherein the coupling means includes integrated coupling parts requiring a substantial bending of the tiles for coupling and separating of the tiles, and wherein both the non-conductive and conductive tiles are made sufficiently resilient to enable the substantial bending.

4. A floor covering according to claim 1, wherein each of the conducting tiles includes a metallic contact block, wire means are disposed beneath the floor covering and are adapted to be connected to the contact block of at least one adjoining tile through associated uniform wire elements having terminals adapted to be connected to the metallic contact block.

5. A floor covering according to claim 1, further comprising a resistance means releasably connected with bottom portions of an electrically conductive tile, and wherein the resistance means is wire connected partly to the individual electrically conductive tile and partly to a ground connection.

6. An element for a floor covering according to claim 1, wherein the plastic tiles are die-cast from an electrically conducting material and shaped corresponding to a structural shape of the plastic tiles on non-conducting material forming part of the same floor covering, said shapes being similar particularly with regard to the coupling means for coupling the adjacent tiles.

7. An element according to claim 6, wherein a metallic block member is embedded in a lower centrally placed cylindrical stub portion of the tile, and wherein said metallic block member is provided with at least one terminal part for connection to at least one electric wire.

8. An element according to claim 7, wherein the at least one terminal part includes four threaded radially extending holes in the metallic block member.

9. A floor covering according to claim 1, wherein the joint plastic tiles include a resilient stepping plate.

10. A floor covering according to claim 9, wherein the stepping plate is perforated.

11. A floor covering according to claim 4, wherein the wire means are connected to several adjoining tiles through associated uniform wire elements.

* * * * *